US005536614A

United States Patent [19]

Kondo et al.

[11] Patent Number: 5,536,614

[45] Date of Patent: Jul. 16, 1996

[54] METHOD FOR MANUFACTURING A NONMAGNETIC SINGLE-COMPONENT DEVELOPER

[75] Inventors: Kunio Kondo; Yujiro Fukuda, both of Tokyo, Japan

[73] Assignee: NEC Corporation, Tokyo, Japan

[21] Appl. No.: 426,617

[22] Filed: Apr. 21, 1995

[30] Foreign Application Priority Data

Apr. 21, 1994 [JP] Japan ..... 6-083270
Jul. 15, 1994 [JP] Japan ..... 6-163518

[51] Int. Cl.[6] ..... G03G 9/087

[52] U.S. Cl. ..... 430/137; 430/903

[58] Field of Search ..... 430/903, 110, 430/106, 137

[56] References Cited

U.S. PATENT DOCUMENTS 5,288,583 2/1994 Osumi et al. ..... 430/903

FOREIGN PATENT DOCUMENTS 48-8141 3/1973 Japan .
51-1130 1/1976 Japan .
54-126031 9/1979 Japan .
57-120943 7/1982 Japan .
60-4459 2/1985 Japan .
62-184473 8/1987 Japan .
1281459 11/1989 Japan .
210419 3/1990 Japan .
4145449 5/1992 Japan .
689045 3/1994 Japan .

*Primary Examiner*—John Goodrow
*Attorney, Agent, or Firm*—Sughrue, Mion, Zinn, Macpeak & Seas

[57] ABSTRACT

A nonmagnetic single-component developer is manufactured by admixing fluoropolymer fine powder to a toner containing a thermoplastic binder resin and a coloring pigment in an amount of 0.1 to 10% by weight of the resultant mixture. The fluoropolymer fine powder has a weight-average particle size smaller than that of the toner, and the amount of particles each having a size not larger than 3 μm and contained in the fluoropolymer fine powder is not larger than 30% by weight. The method may be such that classifying by particle size is effected to the mixture of the toner and the fluoropolymer fine powder to remove smaller particles present therein.

18 Claims, 3 Drawing Sheets

METHOD FOR MANUFACTURING A NONMAGNETIC SINGLE-COMPONENT DEVELOPER

BACKGROUND OF THE INVENTION (a) Field of the Invention

The present invention relates to a method for manufacturing a nonmagnetic single-component developer which is used for developing latent electrostatic images in fields such as electrophotography, electrostatic recording, and electrostatic printing. More particularly, the present invention relates to a method for manufacturing a nonmagnetic single-component developer with negative chargeability which can provide clear images having an excellent image resolution and a high image density substantially without generating fog in a non-image area or background.

(b) Description of the Related Art

Various methods are used for developing latent electrostatic images. For example, in electrophotography, a uniformly charged photoreceptor composed of selenium, zinc oxide, vinyl carbazole compounds, cadmium sulfide, phthalocyanine compounds, etc. is exposed with a light image corresponding to the master drawing to extinguish the electrostatic charge on the exposed portions of the photoreceptor, thereby obtaining a latent electrostatic image on the photoreceptor. A toner composed of a binder resin, a coloring pigment, and other additives is electrostatically deposited on the latent electrostatic image to form a toner image on the photoreceptor. If necessary, the resultant toner image is transferred to an image support such as paper, and the toner thus transferred is fused by heating, softened or dissolved with a solvent, or deformed by application of pressure to be permanently fixed onto the image support.

Developments of latent electrostatic images are categorized, according to the polarities of charged toner and photoreceptor, into a normal development in which a toner and a photoreceptor are charged in opposite polarities, and a reversal development in which a toner and a photoreceptor are charged in the same polarity and a developing bias is applied to the photoreceptor.

Various methods have been used to supply a developer to a photoreceptor in the above-described development, such as a cascade method, a powder cloud method, a magnetic brush method, a jumping method, and a touch-down method. Also, electrostatic image developers are roughly categorized into two-component developers and single-component developers. The two-component developers are composed of a toner and a carrier such as iron powder, steel beads, ferrites, and glass beads having a particle size larger than that of the toner. When two-component developers are used, a latent electrostatic image is developed by the toner charged through friction with the carrier.

The single-component developers are further categorized as magnetic single-component developers and nonmagnetic single-component developers. In the magnetic single-component developers, a toner containing a magnetic substance such as tri-iron tetroxide, di-iron trioxide, and ferrite is used for forming a toner layer on a developer carrying member with the aid of magnetic force, and a latent electrostatic image is developed using the thus formed toner layer. In the nonmagnetic single-component developers, a latent electrostatic image is developed using a toner layer which is formed on a developer carrying member by contact electrification, triboelectrification, etc.

In nonmagnetic single-component development, latent electrostatic images can be developed without using a carrier or a magnetic substance. Accordingly, the development unit can be made smaller and simpler. Presently, a development apparatus utilizing a contact development is widely used. This apparatus comprises at least a toner layer forming member and a developer carrying member to provide electrostatic charges to the toner by contact electrification or triboelectrification and to form a toner layer having a uniform thickness. In this apparatus, the toner layer is contacted with a photoreceptor on which a latent electrostatic image is formed, wherein the toner is supplied onto the latent electrostatic image.

As for the toner, fine divided particles including a thermoplastic resin serving as a binder are used. A coloring pigment, a charge control agent, and other additives are dispersed in the binder resin by melt kneading, and the resulting material is finely milled. The milled particles are classified to obtain a toner comprising fine particles having a diameter of 5–30 μm. Also, another type of a developer is known which is prepared by further adding other materials to the above-described toner so as to impart properties necessary for use as a developer. FIG. 3 shows a conventional process for manufacturing a developer of this type.

Examples of the thermoplastic resins include vinyl resins such as polystyrenes, acrylate polymers, styrene-acrylate copolymers and styrene-butadiene copolymers; and polyesters, epoxy resins, polyamides, polyurethanes, polycarbonates, fluoropolymers, silicone resins, phenol resins, maleic resins, and coumarone resins. Of these, polyesters have particularly excellent (a) chargeability, (b) fixing properties, (c) transparency, (d) gloss, and (e) resistance against the migration to vinyl chloride. Therefore, they have recently become of interest toward practical use as a binder resin.

Regarding electrostatic image developers in which the toner is admixed with fluoropolymer fine particles containing resin, various improvements have been proposed to prevent a toner-filming in which toner particles adhere to a photoreceptor during repeated development operations. For example, Patent Publication No. JP-B-51(1976)-1130 discloses a developer which includes polymer particles which are more electrically negative than sulfur in a triboelectric series. Patent Publication No. JP-B-48(1973)-8141 and Patent Publication No. JP-A-54(1979)-126031 describe developers which include polymer particles having a surface free energy lower than that of the toner, while Patent Publication No. JP-A-1(1989)-281459 describes a developer which includes powder of a low-molecular weight polytetrafluoroethylene.

Also, various improvements have been proposed in relation to methods of manufacturing electrostatic image developers in which a kneaded composite mainly consisting of a thermoplastic binder resin and a coloring pigment is finely milled, and the milled composite is mixed with fine particles which are capable of imparting properties, such as fluidity and uniform triboelectrification, necessary for electrostatic image developers, following which the powder mixture is classified.

For example, Patent Publication No. JP-B-60(1985)-4459 discloses a method for manufacturing a magnetic single-component developer in which finely milled particles of a kneaded composite including a binder resin and magnetic powder are mixed with hydrophobic silica before classification so as to improve the efficiency of the classification and eliminate adverse effects during heat treatment of the electrostatic image developer. Patent Publication No. JP-A-

6(1994)-89045 describes a method for manufacturing an electrostatic image developer in which fine modifying powder is immobilized to finely milled particles of a kneaded composite including a binder resin and a coloring pigment before classification so as to provide the toner with a high fluidity and an excellent durability. Patent Publication No. JP-A-4(1992)-145449 describes a method for manufacturing an electrostatic image developer in which a fluidity-imparting agent is mixed with finely milled particles such as described above in a mixer operating at a high speed, before classification, so as to improve the efficiency of classification.

What is most important in developing latent electrostatic images using the above electrostatic image developers is the quality of images finally obtained. Therefore, developers are desired which provide an excellent image resolution and a high image density without generating fog in the non-image area or irregularity at edges of the image area, especially when developing conditions, such as the charged photoreceptor potential and the latent image potential, vary over a wide range, or especially when the performance of a developer and a development apparatus including a photoreceptor change after repeated developing operation or with the passage of time. Especially, it has been strongly desired to reduce fog caused by electrostatic adhesion of the toner to the non-image area on the photoreceptor, i.e., the unexposed portion on the photoreceptor where charge is maintained. Accordingly, studies have been conducted to reduce the fog.

To solve the above-described problems, various methods have been proposed and are publicly known. For example, Patent Publication No. JP-B-2(1990)-10419 discloses addition of inorganic fine powders having ferroelectricity, while Patent Publication No. JP-A-62(1987)-184473 describes addition of conductive fine particles. Other known methods include addition of inorganic fine powder which has been caused to have hydrophobicity by silane-containing surface treating agents, fluorine-containing surface treating agents, or titanium-containing surface treating agents. Moreover, various improvements in the manner of addition of the fine powder, charge controlling agents, and binder resins are known.

Also, Patent Publication No. JP-A-57(1982)-120943 describes a method of manufacturing an electrostatic image developer in which a toner and an additive such as colloidal silica or polytetrafluoroethylene are mixed without applying a shear force to them so as to make the angle of repose of the developer 50° or smaller.

When development of latent electrostatic images was performed using a developer manufactured by those methods as described above, images having an excellent image resolution and a high image density were sometimes obtained, substantially without causing fog or irregularity at the edges of the images if the development was performed in accordance with a specific development under specific conditions.

However, latent electrostatic images developed in accordance with the nonmagnetic single-component development using the developers as described in the above-mentioned publications or the developers manufactured by the methods described therein cannot always obtain images which satisfy the requirements as described before. Some combinations of components such as binder resins, charge control agents and additives cause adverse effects, thereby generating considerable fog. Also, even in the case where the above-mentioned developers provide clear images substantially without fog, such results are generally obtained only within a narrow range of developing conditions. Accordingly, few developers have been provided which satisfy the requirements for a developer over a wide range of developing conditions (which facilitate the design of a development apparatus) even when the performance of a developer changes after repeated developing operations or a development apparatus including a photoreceptor changes with the passage of time or with the operation period thereof.

SUMMARY OF THE INVENTION

Accordingly, an object of the present invention is to provide a method for manufacturing a nonmagnetic single-component developer having negative chargeability which provides clear images having an excellent image resolution and a high image density as well as reduced fog.

Another object of the present invention is to provide a method for manufacturing a nonmagnetic single-component developer which provides clear images over a broad range of developing conditions while producing reduced fog from a practical low electrostatic potential to a practical high electrostatic potential for a photoreceptor, thereby allowing a wide range of development apparatuses to be employed.

A further object of the present invention is to provide a method for manufacturing a nonmagnetic single-component developer which provides clear images having reduced fog over a broad range of developing conditions and which resists time-dependent changes of a development apparatus including changes in a developer and a photoreceptor after repeated developing operations.

The nonmagnetic single-component developer is manufactured, in accordance with the first aspect of the present invention, by a step of adding fine particles of a fluoropolymer, wherein the weight average particle size of the fluoropolymer particles is not more than that of the toner and the proportion of fluoropolymer small particles each having a particle size equal to or smaller than 3 μm is equal to or less than 30% by weight, to a toner composed mainly of a thermoplastic binder resin and a coloring pigment, in an amount of 0.1 to 10% by weight.

The nonmagnetic single-component developer is manufactured, in accordance with a second aspect of the present invention, by steps of finely pulverizing a kneaded composite composed mainly of a thermoplastic binder resin and a coloring pigment, mixing the resulting pulverized composite and fine particles of a fluoropolymer having a weight-average particle size smaller than that of a toner obtained by classifying the pulverized composite, in a proportion that the fluoropolymer particles are present from 0.1 to 10% by weight of the mixture material, and classifying the obtained mixture by particle size.

Nonmagnetic single-component developers manufactured by the method of the present invention provide excellent advantages. That is, conventional developers have problems in that no charged photoreceptor potential exists which provides practically acceptable clear and sharp images substantially without fog reduced, an extremely high potential is required to obtain acceptable clear and sharp images because fog at low photoreceptor potential is produced in a wide range covering relatively high absolute potentials in negative potential range, and the potential range in which acceptable clear images can be obtained is too narrow because fog at high photoreceptor potential is produced from a relatively low potential, in addition to a low potential generating fog at low photoreceptor potential. By contrast, the nonmagnetic single-component developers provided by the present invention are free from such problems, and provide clear images having excellent image resolution and high image density, as well as reduced fog over a broad range of developing conditions, after repeated developing operations, and even when a development apparatus including a photoreceptor changes with the passage of time.

BRIEF DESCRIPTION OF THE DRAWINGS

The above and other objects, features and advantages of the present invention will be more apparent from the following description, referring to the accompanying drawings in which.

DESCRIPTION OF PREFERRED EMBODIMENTS

Figure 1:
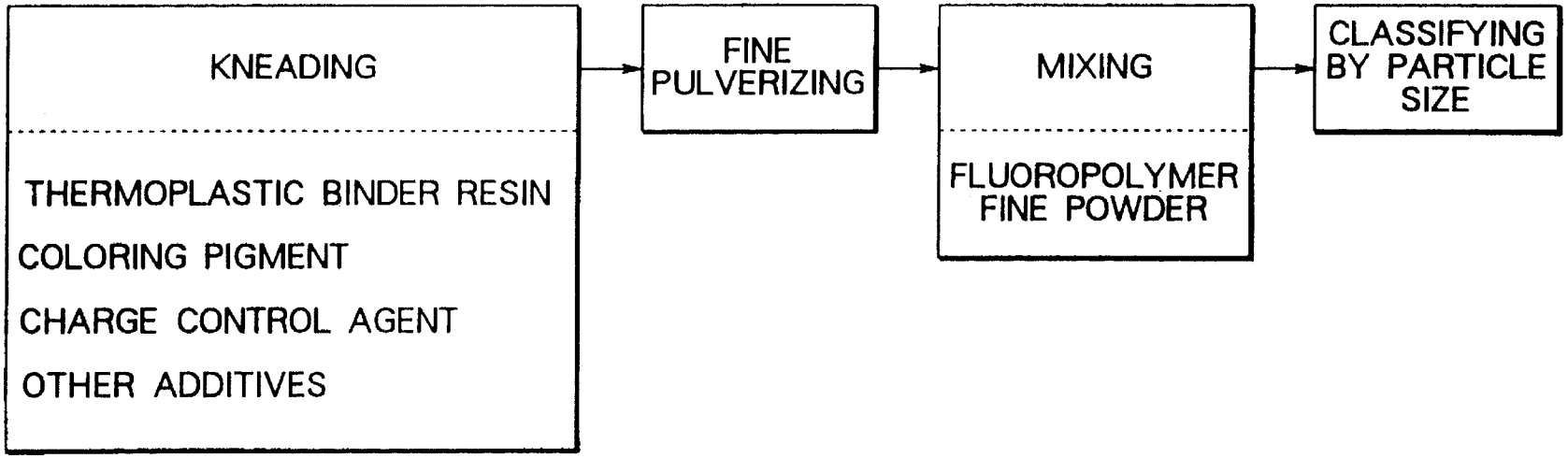
FIG. 1 is a diagram showing a process for manufacturing an electrostatic image developer according to an embodiment of the present invention.

To understand the present invention more clearly, the problems involved in the prior art and solved by the present invention will be detailed before description of the preferred embodiments.

First, variation in fog depending on the developing conditions will be described below by way of an example. In this example, a nonmagnetic single-component developer and a photoreceptor which is capable of being charged negatively are used to effect a reversal development in which each latent electrostatic image is developed while applying a development bias to the photoreceptor.

Latent electrostatic images are developed at different photoreceptor surface potentials by arbitrarily varying solely the surface potential in the negative range from 0 V to the practical limit of the photoreceptor surface potential within which dielectric breakdown does not occur. The degree of fog in a toner image on the photoreceptor or in an image which has been transferred and fixed onto an image support such as paper varies depending on the surface potential. Also, the variation in the degree of fog as a function of the surface potential greatly depends on the developer as used.

When the charged photoreceptor potential is varied from 0 V in the negative direction, an electrostatic repulsive force increases between the developer and the non-image area on the photoreceptor, i.e., the unexposed portion on the photoreceptor surface where negative charge is maintained. As a result of the increase in the electrostatic repulsive force by the surface potential, toner is prevented from electrostatically adhering to the non-image area, so that the fog can be reduced, resulting in improvement in clearness of the image. Also, when the absolute surface potential is progressively increased in the negative direction, fog is reduced to a minimal level at a certain surface potential, providing no further reduction in fog along with the further increase in potential in the negative direction. In some developers, fog again increase due to unknown reasons when the surface potential increases in the negative direction. Accordingly, clear images can be obtained at a certain potential for each of the developers.

However, conventional nonmagnetic single-component developers or the developers disclosed in the above-mentioned publications and the developers manufactured by the methods disclosed in the above-mentioned publications do not provide satisfactory clear images in which fog has been sufficiently reduced even if the development is performed using a photoreceptor surface potential that minimizes fog within a practical range of the surface potential. Even when the fog can be sufficiently reduced by adjusting the surface potential, a highly negative potential must be generally used as the charged photoreceptor surface potential. Also, when the surface potential is increased in the negative direction past that potential, fog significantly increases so that acceptable clear images cannot be obtained.

Figure 2:
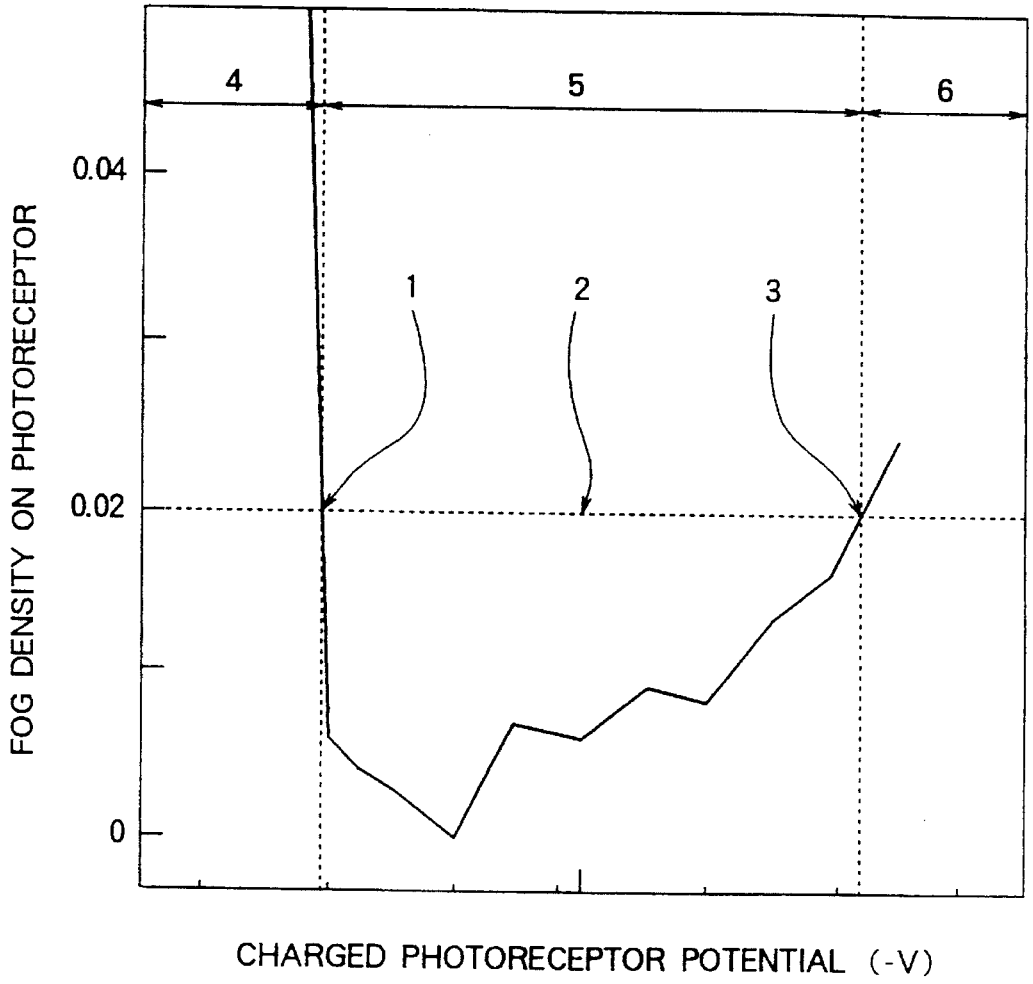
FIG. 2 is an exemplary graph showing variation in a fog density on a photoreceptor as a function of the charged photoreceptor potential varied within a practical potential range.
Figure 3:
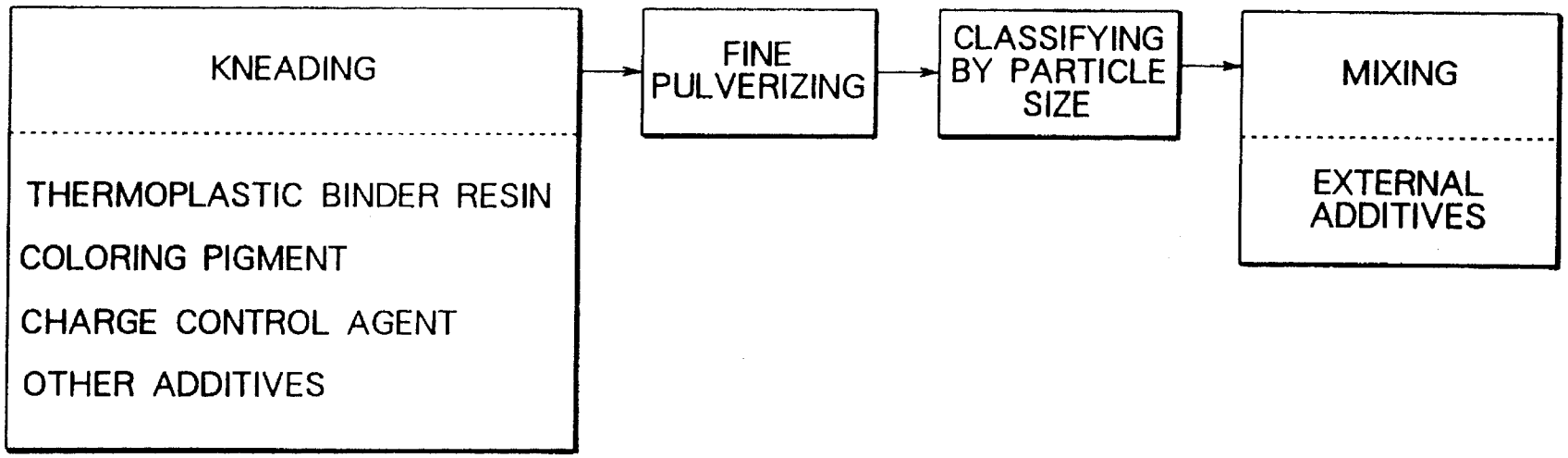
FIG. 3 is a diagram showing a conventional process for manufacturing an electrostatic image developer.

If a certain photoreceptor surface potential exists which provides acceptable clear images having sufficiently reduced fog, then fog produced at the lower side of the limit of the range within which acceptable images are produced is called "low potential fog". Fog produced at the higher side of the limit of the range within which acceptable images are obtained is called "high potential fog". The width of the potential range in which acceptable images can be obtained is accordingly represented by the absolute value of the difference between the critical potential at which high potential fog is generated and the critical potential at which low potential fog is generated. FIG. 2 shows an example of variation in the fog density on a photoreceptor, which will be described later, when the surface potential of charged photoreceptor is varied within a practical potential range.

When a latent electrostatic image is developed by using conventional developers, problems sometimes occur that no surface potential exists which provides acceptable clear images having sufficiently reduced fog, that an extremely high absolute potential is required to obtain acceptable clear images because low potential fog is produced in a wide range of the potential, or that the potential range in which acceptable clear images can be obtained is extremely narrow because high potential fog is produced from a relatively low negative potential in addition to low potential fog. Accordingly, the above-described requirements are not satisfied in the prior art.

Electrostatic image developers which comprise a toner and fluoropolymer fine particle resin incorporated therein and which are disclosed in the above-described Publication Nos. JP-B-51-1130, JP-B-48-8141, JP-A-54-126031, and JP-A-1-281459 have limited practical objects for avoiding insufficient cleaning and toner-filming caused by the physico-chemical adhesion of the toner to the photoreceptor. Accordingly, the problem of fog, which is recognized as stains produced by electrostatic adhesion of the developer to the non-image area on the photoreceptor on which a latent electrostatic image is formed, is not solved by those publications. That is, the mixing of fluoropolymer fine particles into a toner is considered to be incapable of reducing the fog which is produced depending on the surface potential of the photoreceptor.

In those publications, both the surface free energy of fine resin powder to be mixed and triboelectrification series are defined, and the incorporation of a fine powder of a fluoropolymer, such as polytetrafluoroethylene and polyvinylidene fluoride, and a fine powder of polyethylene is disclosed. However, developers containing polytetrafluoroethylene powder, which includes a considerable proportion of very fine particles, do not solve the above-described problems but rather increase fog within the entire practical range of the potential of the photoreceptor. Similarly, developers containing fine powder of polyvinylidene fluoride, polyethylene, or the like neither solve the above-described problems nor provide images having a sufficient density. Even if the mechanism for cleaning the photoreceptor surface is improved or the photoreceptor itself is improved to prevent the insufficient cleaning and the toner-filming over the photoreceptor surface, the above-described problems remain due to the surface potential of the photoreceptor.

Also, the methods of manufacturing electrostatic image developers disclosed in Patent Publication Nos. JP-B-60-4459, JP-A-6-89045 and JP-A-4-445449 comprise the steps that a kneaded composite mainly composed of a thermoplastic binder resin and a coloring pigment is finely milled, and fine particles are added to the resulting milled material to impart properties required as electrostatic image developers, such as fluidity and uniform triboelectrification properties, followed by a step of classification of the resulting fine powder by particle size. Those steps, however, have a limited object of improving the efficiency of classification, imparting fluidity and durability to electrostatic image developers, and suppressing adverse effects during heat treatment of the electrostatic image developers. Accordingly, the developers manufactured by the methods disclosed in those publications cannot reduce fog which is generated as a function of the surface potential of the photoreceptor and as a result of the electrostatic adhesion of the developer to the non-image area on the photoreceptor on which a latent electrostatic image is formed. Moreover, those publications disclose the use of a fine powder having an average particle size of 3 μm or less as the fine powder to be blended with the finely milled particles. However, electrostatic image developers which are prepared by those methods using fluoropolymer fine particles having such a particle size cannot solve the above-described problems but rather increase fog within the practical potential range of the photoreceptor.

The method for manufacturing an electrostatic image developer which is described in Patent Publication No. JP-A-57-120943 recites that a toner and an additive are mixed without applying a shear force so as to make the angle of repose of the developer 50° or smaller. This method cannot also solve the above-described problems but rather increases the fog within the practical potential range of the photoreceptor if colloidal silica, an azo dye, or carbon black is used as an additive. In the case where polytetrafluoroethylene fine particles are used as an additive, the above-described problems cannot be solved, because those particles have a broad distribution range of particle size and the content of very fine particles having a particle size of 3 μm or less is not negligible. Especially, when the proportion of very fine particles is excessively high, the fog increases within the practical potential range of the photoreceptor, resulting in adverse effects.

We conducted extensive studies to solve the above problems, and found that a certain nonmagnetic single-component developer provides acceptable clear images having an excellent image resolution and a high image density and having reduced fog over a broad range of developing conditions including changes of a developer after repeated operations and changes of a developing apparatus including a photoreceptor caused by the passage of time.

Now, the present invention will be described in detail below.

As a result of studies, we found that, in electrostatic image developers comprising a finely divided fluoropolymer powder and a toner composed mainly of a thermoplastic binder resin and a coloring pigment, the proportion of powder particles having a size equal to or smaller than 3 μm in the fluoropolymer powder should be reduced. A nonmagnetic single-component developer manufactured according to the present invention comprises a toner and a finely pulverized fluoropolymer powder admixed therein in a proportion of 0.1 to 10% by weight based on the weight of the resultant mixture, the toner being composed mainly of a thermoplastic binder resin and a coloring pigment. The weight-average particle size of the fluoropolymer fine powder is not more than that of the toner, and the proportion of small particles having a diameter not more than 3 μm is equal to or less than 30% by weight in the fluoropolymer powder.

Finely pulverized fluoropolymer powder which is generally available or manufactured has a broad range of particle size distribution, and therefore, there may be an inconvenience in that only a limited species of fluoropolymer powder, which does not satisfy the contents as described above, can be obtained from the market in some cases. In these cases, the second aspect of the present invention is conveniently employed. It is possible to include in the first aspect of the present invention a step of classifying a fluoropolymer fine powder having a broad range of particle size distribution to lower the proportion of particles having a diameter equal to or smaller than 3 μm to not more than 30% by weight before adding it to the toner. This approach, however, makes the total manufacturing process somewhat complicated because of the inclusion of a classifying step.

According to a preferred embodiment of the present invention, a nonmagnetic single-component developer is manufactured by steps of finely pulverizing a kneaded composite composed mainly of a thermoplastic binder resin and a coloring pigment, mixing the resulting pulverized material with a fluoropolymer micropowder having a weight-average particle size smaller than that of a toner obtained by classifying the pulverized material such that the proportion of the fluoropolymer micropowder is 0.1 to 10% by weight of the resultant mixture, and classifying the obtained mixture by particle size. With this process, the amount of minute particles contained in the fluoropolymer micropowder can be reduced. The method of the preferred embodiment permits many species of fluoropolymer micropowder to be used without causing a complexity of the manufacturing process.

The kneaded composite can be manufactured by a known method. A binder resin, a coloring pigment, and other additives are blended or mixed in a preliminary step. Subsequently, the resulting mixture is kneaded and dispersed using a roller, bunbury mixer, extruder, or a kneader. The obtained kneaded composite solid material is cooled and roughly pulverized to particles having 1 mm or less in size with a hammer mill or similar means to obtain a kneaded composite.

FIG. 1 shows a process for the manufacture of the electrostatic image developer according to a preferred embodiment of the present invention. After a pulverizing step, a mixing step is provided in which the pulverized material is combined with a fluoropolymer micropowder. Subsequently, a classifying step is provided in which fine particles contained in the pulverized material and fine particles in the fluoropolymer micropowder are simultaneously removed. The classifying conditions of the mixture may be those for obtaining a toner having a predetermined average particle size by subjecting solely the pulverized material to a classification step for removing small particles. By increasing or decreasing the amount of the fluoropolymer fine powder, it is possible to manufacture the electrostatic image developer capable of exhibiting the effects of the present invention under those conditions.

It is preferred that the mixture obtained by incorporating the fluoropolymer fine powder into the pulverized material exists in the state that the fine powder is not adhered to the pulverized material or is very weakly adhered thereto so that they are separable by a dispersing action to which the mixture is subjected in the classifying apparatus. More preferably, the mixing operation does not involve a shear force. If a high shear force is present in the mixing step as in the case where a high-speed flow type mixer such as a Henschel mixer (trademark) is used, the fluoropolymer micropowder is divided into even smaller particles, and in addition, small particles of the fluoropolymer micropowder which must be removed in the classifying step are sometimes firmly adhered to the surfaces of the toner particles which are to be recovered as the end product, resulting in an inclusion of small particles in the electrostatic image developer product. The thus-obtained electrostatic image developer cannot achieve the advantages of the present invention, i.e., reduced fog and enhanced image resolution, but rather significantly increases fog.

In a preferred embodiment, mixers of a container-shaking type are used to effect mixing without a shear force. In the use of the mixers of a container-shaking type, the container containing the pulverized material and the fluoropolymer particles is shaken by a rotating movement, reciprocating movement, or other types of movement to effect uniform mixing under mild conditions without applying a vigorous force to the pulverized material and the fluoropolymer particles. Examples of the mixers of this type include horizontal cylinder mixers, V-type mixers, double conical mixers, and Turbula-Shaker-Mixer (trademark), among which Turbula-Shaker-Mixer is preferred. As a mixing method without involving a shear force, a simultaneously supplying of the pulverized material and the fluoropolymer fine powder into a classifying apparatus may also be used. By supplying the pulverized material and the fluoropolymer fine powder at predetermined relative rates from the same supply port to the apparatus, a mild mixing, dispersing, and classifying of the pulverized material and fluoroplymer fine powder simultaneously proceed, obtaining an electrostatic image developer from which very small particles in fluoropolymer fine powder are removed. Examples of the classifying apparatus which may be used in the present embodiment include inertia classifiers, forced vortex centrifugal classifiers, and free vortex centrifugal classifiers. Particularly, Tripton, Dispersion Separator, Accucut, Teeplexe, Super Separator, and Fine Sharp Separator (all trademarks) are preferably used.

Moreover, as a mixing method without involving a shear force, atomizing of the fluoropolymer micropowder to the pulverized material may be used. For example, the above-mentioned mixers of a container-shaking type equipped with an atomizer for a powder such as an air gun are used, and a predetermined amount of the fluoropolymer powder is atomized from the atomizer onto the pulverized material in a batch process while shaking the pulverized material. Alternatively, a pulverizing apparatus equipped with an atomizer may be used in the above-described pulverizing step, and the transfer of the pulverized material from the pulverizing step to the classifying step during which pulverizing of the kneaded composite is effected simultaneously with atomizing the fluoropolymer at a predetermined rate from the atomizer may be performed by way of pneumatic transportation using a piping equipped with a atomizer in a continuous process.

in the case where the pulverizing apparatus is a jet mill using compressed air in which particles of the kneaded composite are rendered to collide with each other in a supersonic air stream to effect pulverizing, or the kneaded composite accelerated in a supersonic nozzle is smashed onto a target to effect pulverizing, the compressed air may contain the fluoropolymer micropowder at a predetermined concentration, and pulverizing of the kneaded composite and the mixing of the pulverized material and the fluoropolymer powder may be effected simultaneously. If the pulverized material is transported by air, the air for transportation may contain the fluoropolymer powder at a predetermined concentration, and the transfer of the pulverized material and the mixing of the pulverized material and the fluoropolymer fine powder may be effected simultaneously.

In a preferred embodiment, it is possible to use a finely pulverized fluoropolymer micropowder having a weight-average particle size smaller than that of the toner which is obtained after the pulverized material is subjected to a classifying step. The toner has, for example, a weight-average particle size of not less than 5 μm, and the particles are controlled to have a size of not more than 30 μm. Fluoropolymer fine powder has an average particle size smaller than the above-mentioned average particle size of the toner and preferably has a weight-average particle size of 3 to 20 μm.

If the weight-average particle size of the fluoropolymer micropowder is smaller than 3 μm, minute fluoropolymer particles may be firmly adhered to the particle surface of the pulverized material in the step of mixing the pulverized material and the fluoropolymer powder. Further, in the subsequent classifying step, minute particles in the fluoropolymer fine powder adhered to particles of the pulverized material, which is to be obtained as the toner product, cannot be removed under classifying conditions for obtaining a predetermined average particle size. As a result, it may be the case that the thus-obtained electrostatic image developer cannot achieve the advantages of the present invention, i.e., reduced fog and enhanced image resolution, but rather significantly increases fog. Moreover, it may be difficult to obtain electrostatic image developers which have a broad electrostatic potential range in which the critical potential at which low potential fog occurs falls while reducing high potential fog to thereby reduce fog, and which suppresses fog and enhances image resolution in a wide range of developing conditions (which facilitate the design of a development apparatus) even when the performance of a developer and a developing apparatus including a photoreceptor changes after repeated operations and with the passage of time.

If the weight-average particle size of the fluoropolymer fine powder is greater than 20 μm, it may be the case that electrostatic image developers which exhibit the advantages of the present invention are not obtained, but rather, electrostatic image developers which cause poor image resolution and defective fixing of the developer is resulted.

The term "weight-average particle size" as referred to in the text is meant by a median obtained from the particle size distribution of the fluoropolymer powder on the weight basis. The particle size distribution on the weight basis is measured using an apparatus based on laser diffraction, a Coulter counter (manufactured by Coulter), or centrifugal sedimentation. Alternatively, a particle size distribution profile on the number basis is first obtained by counting the particle number with a scanning electron microscope or the like and then converted to a distribution profile on the weight basis. The average particle size of the fluoropolymer powder and the amount of minute particles vary depending on the method of measuring the particle size and the method of preparing a sample to be measured. It is noted that in a so-called wet method in which the fluoropolymer powder is dispersed in a dispersing medium such as water or an organic solvent along with a suitable dispersant before being subjected to a measurement of the particle size, the fluoropolymer powder is often insufficiently dispersed in the dispersing medium, making it difficult to obtain an accurate particle size distribution profile.

With the present invention, the weight-average particle size and the proportion of very fine particles calculated from the particle size profile a weight basis may be measured by way of a dry method using a HELOS & RODOS laser diffraction particle distribution analyzer (manufactured by Synpatec) using a dry-type dispersing unit (RODOS). Dispersion of the fluoropolymer powder in a dispersion unit may be carried out by using a shear force of an air stream generated from compressed air (5 bar) or combining the shear force and collision against the wall of the unit equipped with a cascade, after which the average particle size and particle size distribution are measured.

It is essential that the average primary particle size of the fluoropolymer fine powder is smaller than the average particle size of the toner which may be obtained by classifying the above-described pulverized material, and it is no problem if the fine particles should be aggregated to form secondary particles. The fluoropolymer fine particles call be prepared by suspension polymerization, followed by low-temperature pulverization of the fluoropolymer powder or pulverization after irradiation of the fluoropolymer powder by radioactive rays. In the present embodiment, although a fluoropolymer fine powder containing a significant amount of minute particles is used, the minute particles are removed in the subsequent classifying step. Therefore, the advantages of the present invention are not ill-affected by the particle size distribution of the fluoropolymer micropowder itself.

Examples of the fluoropolymer which may be used in the present invention include polytetrafluoroethylene, tetrafluoroethylene-perfluoroalkyl ether copolymers, tetrafluoroethylene-hexafluoropropylene copolymers, tetrafluoroethylene-hexafluoropropylene-perfluoroalkyl vinyl ether copolymers, tetrafluoroethylene-ethylene copolymers, polychlorotrifluoroethylene, chlorotrifluoroethylene-ethylene copolymers, and mixtures thereof. It is particularly preferred to use polytetrafluoroethylene, tetrafluoroethylene-perfluoroalkyl ether copolymers, or tetrafluoroethylene-hexafluoropropylene copolymers as the fluoropolymer according to the present invention. It should be noted that the present invention is not limited to the properties of the fluoropolymer fine powder including molecular weight, distribution of molecular weight, crystallinity, melting point etc.

With the present invention, the fluoropolymer fine powder is incorporated in an amount of 0.1 to 10% by weight, preferably 0.2 to 7% by weight. If the proportion of the fluoropolymer powder in the pulverized mixture material is less than 0.1% by weight, the advantages of the invention, that the electrostatic image developers provide reduced fog and an enhanced image resolution, cannot be obtained. Even in the case where the advantages are obtained, they are recognized only in narrow developing conditions, and therefore, it is not possible to obtain electrostatic image developers which have a broad electrostatic potential range between the critical lower potential at which low potential fog occurs and the critical higher potential at which high potential fog occurs, and which suppress fog and enhance image resolution in a wide range of developing conditions (which facilitate the design of a development apparatus) when the developer is changed after repeated operations or the development apparatus including a photoreceptor changes with the passage of time.

By contrast, if the proportion of the fluoropolymer fine powder in the pulverized mixture material is in excess of 10% by weight, electrostatic image developers which provide increased high potential fog, a fall in potential at which high potential fog occurs, poor image resolution, and defective fixing are result.

In the present invention, binder resins known in the art may be used for toners as the thermoplastic binder resin which constitutes the kneading composition mentioned above. Examples of the thermoplastic resins which can be used as the binder resin include vinyl resins such as polystyrene, acrylate polymer, styrene-acrylate copolymers, and styrene-butadiene copolymers; polyesters, epoxy resins, polyamides, polyurethanes, polycarbonates, fluoropolymer, silicone resins, phenol resins, maleic resins, coumarone resins, etc.

Among the resins as mentioned above, polyester resins are particularly preferred in the present invention since they have excellent chargeabilities including polarity and charging stability, which are generally required for binder resins for toners. The polyester resins are prepared by using a dicarboxylic acid and a diol and a phenol which are capable of being polycondensed with the dicarboxylic acid as starting constituent monomers. If necessary, the starting monomers may further include carboxylic acids having high valence such as a tricarboxylic acid, a tetracarboxylic acid, a polycarboxylic acid, or a carboxylic acid copolymer; high valent alcohols such as triol, tetraol, or polyol; or isocyanate compounds to form a cross-linked structure within the resin.

Examples of the dicarboxylic acid include maleic acid, citraconic acid, itaconic acid, fumaric acid, mesaconic acid, glutaconic acid (unsaturated aliphatic dicarboxylic acid), oxalic acid, malonic acid, succinic acid, glutaric acid, adipic acid, pimelic acid, suberic acid, azelaic acid, sebasic acid, cyclohcxane dicarboxylic acid (saturated dicarboxylic acid), phthalic acid, isophthalic acid, terephthalic acid, 1,5-naphthalene dicarboxylic acid, 2,6-naphthalene dicarboxylic acid (aromatic dicarboxylic acid); as well as acid anhydrides and lower alkyl esters thereof.

Examples of the diol which undergoes polycondensation along with the above-mentioned dicarboxylic acids thereby producing polyesters include ethylene glycol, diethylene glycol, triethylene glycol, 1,2-propylene glycol, 1,3propylene glycol, dipropylene glycol, trimethylene glycol, 1,4-butanediol, 1,4-butenediol, 1,5-pentanediol, neopentyl glycol, 1,6-hexanediol, 1,7-heptanediol, 1,8-octanediol, 1,10-decanediol, pinacol, hydrobenzoin, benzpinacol, cyclopentane-1,2-diol, cyclohexane-1,2-diol, cyclohexane-1,4-diol and 1,4-bis(hydroxymethyl)cyclohexane.

Examples of the tricarboxylic acid include tricarballylic acid, 1,2,3-butanetricarboxylic acid, 1,2,4-butanetricarboxylic acid, 1,2,5-hexanetricarboxylic acid, 1,2,4-cyclohexane tricarboxylic acid, 1,2,4-benzene tricarboxylic acid, 2,5,7-naphthalene tricarboxylic acid, 1,2,4-naphthalene tricarboxylic acid; as well as acid anhydrides and lower alkyl esters thereof.

Examples of the triol include glycerol, 1,2,4-butanetriol, 1,2,5-pentanetriol, 2-methylpropanetriol, 2-methyl-1,2,4-butanetriol, trimethylolethane and trimethylolpropane.

Examples of the phenol include catechol, resorcinol, hydroquinone, pyrogallol, phloroglucinol, 1,2,4-benzenetriol, 1,3,5-trihydroxymethylbenzene, bisphenol A, hydrogenated bisphenol A, polyoxyethylene adduct of bisphenol A and polyoxypropylene adduct of bisphenol A.

The polyester binder resins as mentioned above may be used as a single material or as a mixture of two or more of them, or as a block copolymer or a graft copolymer obtained by using two or more of these binder resins. The above polyester resins may be mixed, block-copolymerized, or graft-copolymerized with other species of resins. The binder resins include, for example, vinyl resins such as polystyrene, acrylate polymers, styrene-acrylate copolymers, and styrene-butadiene copolymers; or epoxy resins, polyamides, polyurethanes, polycarbonates, fluoropolymer, silicone resins, phenol resins, maleic resins, and coumarone resins.

It is particularly preferred in the present invention to use a polyester resin prepared using terephthalic acid, 1,2,4-benzenetricarboxylic acid, polyoxyethylene adduct of bisphenol A, or polyoxypropylene adduct of bisphenol A; or a polyester resin EX-102 or EX-103 manufactured by Sanyo Chemical Industries, Ltd., prepared by graft polymerization of the above polyester resin consisting of a polycarboxylic acid and polyols with a backbone polymer which is an oxyalkylene ether of a novolak type phenol resin prepared by adding an alkylene oxide to a novolak type phenol resin.

Moreover, in the present invention, it is preferred that an inorganic fine powder is mixed with the pulverized material in an amount of 0.1 to 5% by weight before the pulverized material and the fluoropolymer fine powder are mixed. By mixing the inorganic fine powder with the pulverized material before the fluoropolymer powder is mixed with the pulverized material, the advantages of the present invention can be further enhanced including reduced fog as a result of a fall in the low potential fog generating surface potential and reduction in high potential fog, enhanced image resolution, a broader range of surface potential of the photoreceptor over which fog is sufficiently suppressed, and reduced fog in a wide range of developing conditions when the performance of a developer and a development apparatus including a photoreceptor change after repeated developing operations and with the passage of time, respectively.

In the case where the inorganic fine powder is mixed with the pulverized material after the fluoropolymer fine powder is mixed with the pulverized material, or in the case where the inorganic fine powder is mixed with a toner which has been obtained by classifying a mixture of the fluoropolymer powder and the pulverized material, a modification to the mixture of the fluoropolymer powder and the pulverized material or the toner results depending on the manner in which the inorganic fine powder is mixed with the mixture of the fluoropolymer powder and the pulverized material or the toner. Such a modification is caused by the fluoropolymer particles firmly adhering to the surface of the pulverized material in the mixture, and the fluoropolymer particles adhering to the pulverized material obtained when a toner is not removed by a classification performed under conditions suitable for obtaining a predetermined average particle size. Similarly, in the case where the inorganic fine powder is mixed with the toner, the breakage or corruption of the fluoropolymer powder in the toner, which will cause pulverization of the resin powder, is caused by the modification to the toner resulting from the manner of mixing, or the mixing conditions. Accordingly, the mixing of the inorganic fine powder cannot provide an electrostatic image developer in which fine particles of a fluoropolymer powder exist in the toner and which provides the advantages of the present invention, i.e., the sufficient reduction of fog, and the enhancement of the image resolution. Also, an electrostatic image developer thus obtained does not provide advantages of a wide electrostatic potential range, within which fog is sufficiently reduced, by reduction of the critical lower potential at which low potential fog occurs and by reduction of the high potential fog, of suppressing fog and enhancing image resolution in a wide range of developing conditions.

The inorganic fine powder should have a primary particle size of 0.001 to 2 μm, preferably 0.002 to 0.2 μm. No adverse effect will be generated even if the particles are aggregated to form secondary particles. In the present invention, the inorganic fine powder is preferably incorporated into the pulverized material in an amount of 0.1 to 1% by weight of the resultant mixture.

While it is preferable that the inorganic fine powder is made of a metal oxide, such as silica, tin oxide, aluminum oxide, titanium dioxide, zinc oxide and the surface modified of them, it is more preferable to use silica fine particles referred to herein as dry process silica or colloidal silica formed by vapor phase oxidation of silicon halide. Further, a hydrophobic silica prepared by surface modifying an essentially hydrophilic silica with a hydrophobisation agent may preferably be used. Such silica can be exemplified by a hydrophobic silica prepared by substituting the silanol groups on the surface of the silica fine powder with organic groups through reaction between a silica fine powder and a silane coupling agent such as dichlorodimethylsilane, hexamethyldisilazane and trimethylsilane or a titanium coupling agent such as isopropyltriisostearoyl titanate, isopropyltridodecylbenzensulfonyl tritanate and tetraisopropyl bis(dioctylphosphate)titanate to make the surface of the silica fine powder hydrophobic.

The inorganic powder can be mixed with the pulverized material by a method similar to the method used for mixing the fluoropolymer micropowder with the pulverized material, i.e., a method which utilizes no shear force. Examples of such a method include one in which mixing is performed using a mixer which shakes a container, and one in which the inorganic fine powder is atomized into the pulverized material.

Also, physical and chemical methods can be used for mixing. Examples of the physical methods include adhesion and immobilization of the fine powder onto the pulverized material utilizing mechanical shear, immobilization of the former onto the latter utilizing a combination of mixing and heating, and immobilization of the former onto the latter utilizing a combination of mixing and mechanical impact.

Examples of the chemical methods include immobilization by means of covalent bond between the pulverized material and fine powder or of chemical bond such as hydrogen bond. A method in which the inorganic fine powder is mixed with the pulverized material by mechanical shear or shaking motion is particularly preferred in the present invention. Such mixing of the pulverized material and the inorganic fine powder can be carried out using an agitating type mixer, an air-flow agitating type mixer, a high-speed flow type mixer, a V-type mixer, a conical screw mixer, a double conical mixer, a bail mill a Turbula-Shaker-Mixer (trademark), etc. The high-speed flow type mixer equipped with a high-speed stirring blade therein which allows the inorganic fine powder to be mixed with the pulverized material by a shear force or a Turbular-Shaker-Mixer are particularly preferable in the present invention.

As the coloring pigment forming the above-described kneaded composite, any well-known coloring pigment such as carbon black, iron black, Ultramarine Blue, Aniline Blue, Phthalocyanine Blue, Phathalocyanine Green, Calco Oil Blue, Chrome Yellow, quinacridone, Indanthrene Blue, Peacock Blue, Permanent Red, Lake Red, Rhodamine Lake, Hansa Yellow, Permanent Yellow, Benzidine Yellow and Rose Bengal can be used. While the amount of these coloring pigments to be added resides in a wide range, it is usually added in the range of 1 to 20 parts by weight per 100 parts by weight of the binder resin.

The electrostatic image developer may, if necessary, incorporate a known low-molecular weight polyolefin to prevent offset. The low-molecular weight polyolefins which can be employed include, for example, polyolefins and co-polyolefins such as paraffin, chlorinated paraffin, polyethylene, chlorinated polyethylene, polyethylene oxide, ethylene-vinyl acetate copolymer, ethylene-acrylic acid copolymer, ethylene-acrylate copolymer, ethylene-methacrylic acid copolymer, ethylene-methacrylate copolymer, ethylene-vinyl chloride copolymer, ethylene-butene copolymer, ethylene-pentene copolymer, polypropylene, polypropylene oxide, ethylene-propylene copolymer, propylene-butene copolymer, propylene-pentene copolymer, ethylene-propylene-butene copolymer, ethylene-3-methyl-1-butene copolymer and polyisobutylene. These low-molecular weight polyolefins can be incorporated as a single material or in combination thereof into the electrostatic image developer. While the polyolefin wax can be used over a wide range, it is usually added to the kneaded composite in an amount of 0.3 to 5 parts by weight based on the amount of the binder resin.

Further, a charge control agent may, if necessary, be incorporated into the kneaded composite to generate charge in the developer or stabilize the charge of the developer. Charge control agents which may be employed in the present invention include azo-metal complex compounds, chlorinated polyolefins, chlorinated polyesters, sulfonylamine of copper phthalocyanine, oil black, metal salts of naphthenic acid and metal salts of fatty acids.

To impart to the developer flowability, developing and transferring properties, storage stability, anti-filming property (resistance to toner-filming over a photoreceptor) and cleaning property, well-known external additives other than the inorganic fine power may be further admixed with the pulverized material before adding the fluoropolymer fine powder into the pulverized material. Such external additives include long-chain fatty acids such as stearic acid and esters, amides or metal salts thereof, carbon black, graphite, graphite fluoride and polycyclic aromatic compounds.

Removal of fine particles of the fluoropolymer powder in the classification step for the mixture of the pulverized material and the fluoropolymer powder can be clearly confirmed by measuring the distribution of particle size based on the number of particles. The distribution of particle size is measured for each of a toner which is obtained by classifying the pulverized material using the above-described particle size distribution measuring method based on the weight, a toner which is obtained by classifying the mixture, and a toner which is obtained by adding the fluoropolymer powder into the classified particles of the pulverized material.

When these particle size distributions are compared, only slight differences are observed among them due to the small weight-average particle size of the resin powder, and the small mixing amount. However, when they are compared with each other based on their particle size distributions determined based on the number of particles, clear differences can be obtained. That is, it is confirmed that the particle size distribution of the toner obtained by classifying the pulverized material only is substantially equal to that of the toner obtained by classifying the mixture, and that the toner obtained by adding the fluoropolymer powder into the classified particles of the pulverized material contains fine particles having a size equal to or less than 3 μm in a higher rate as compared to the former two cases.

Accordingly, the removal of fine particles from the fluoropolymer powder can be clearly confirmed based on the amount of the fine particles determined based on the number of particles. The particle size distribution based on the number of particles can be directly measured with a device similar to that used for the measurement of particle size distribution based on the weight of particles, or be obtained by measuring the particle size distribution based on the weight of particles and converting it to a particle number-base particle size distribution. Particularly, a particle size distribution measuring apparatus of a laser diffraction type, and a Coulter counter are preferred.

The level of fog generated by the developers manufactured according to the present invention can be evaluated as follows. First, a solid white background image is developed. In this case, the entire surface of the photoreceptor is a non-image section. The fog density caused by an electrostatic deposit of the developer on the photoreceptor is measured for evaluation. Alternatively, the solid white background image is transferred onto an image support such as paper after a developing step, fixed thereon, and the fog density over the support which the developer has been transferred to is measured for evaluation. In order to determine the fog density on the photoreceptor which the developer has contacted, the white background image is developed, and this developing process is interrupted before being completed.

Next, a transfer medium such as an adhesive transparent tape is affixed to part of the photoreceptor that is basically the section to be transferred onto a support for image such as paper. In other words, the tape is located between the position of the developed electrostatic latent image and the position of transfer. Subsequently, the developer deposited on the photoreceptor is transferred to the transfer medium by the physicochemical adhesive force. A transfer medium to which the developer was transferred from the photoreceptor is bonded to a sheet of paper to obtain a sample. Optical reflective density is measured, and from the obtained density, optical reflective density of a blank transfer medium attached to a support is subtracted to obtain a fog density.

In order to determine the fog density on the image support to which the developer has adhered, the above-mentioned solid white image is developed, transferred, and fixed under appropriate conditions. The support to which the developer is fixed on the non-image section was used as a sample. The fog density is obtained by subtracting the optical reflective density measured in the sole presence of the support from the optical reflective density of the sample, which results in the density in the sole presence of the developer.

The developing conditions which were changed in the process of the present invention included: charging methods for photoreceptors which included brush charging, scorotron charging, and roller charging; surface potential of charged photoreceptors; developers that had deteriorated after repeated developing operations; developing apparatuses that were affected by the passage of time.

In the present invention, "acceptable clear images having reduced fog" means images having a fog density on the photoreceptor not more than 0.02, or having a fog density on the image support of not more than 0.01 and a image density of more than 1.30 of a black solid image after developed and fixed onto a image support.

The range of the developing conditions over which the acceptable clear images are obtained is determined from the charging method employed and from variation in the density of fog of a solid white image when the charged photoreceptor potential is arbitrarily varied within a practical range. In detail, the range of the developing conditions are indicated by a combination of the arbitrary charging method and the absolute value of the difference between a maximal surface potential and a minimal surface potential within which acceptable levels of fog are obtained, the acceptable levels of fog being defined to be not more than 0.02 measured in the employed charging method.

The absolute value is alternatively expressed by the difference between the high potential fog generating surface potential which provides a fog density greater than 0.02 and the low potential fog generating surface potential which provides a fog density greater than 0.02. By measurement of the optical reflective density of the solid black image developed at a potential of the photoreceptor within the range from the high potential fog generating surface potential and the low potential fog generating surface potential, it is possible to confirm that a sufficient image density can be obtained in this range.

Similarly, the range of the developing conditions, for obtaining acceptable clear images in the case where changes in the developer after repeated developing operations and changes in the development apparatus due to the passage of time are involved, can be obtained from the change in a fog density of the solid white image as a function of the photoreceptor potential during an initial development by a development apparatus utilizing a fresh developer and a photoreceptor, as well as from the change in fog density after repeated developing.

In addition, from the measurement of the optical reflective density of the solid black image developed at a photoreceptor potential within the range from the high potential fog generating surface potential and the low potential fog generating surface potential during an initial stage of development, it is possible to confirm that images having a high density can be obtained which are not affected by changes in the developer and the development apparatus including changes in a photoreceptor after repeated use for developing processes and the passage of time.

The present invention will now be described by way of Preparation Examples and Embodiments together with Comparative Examples. However, the present invention should not be construed as being limited to the Embodiments or Preparation Examples. In the following examples and embodiments, "part(s)" means part(s) by weight of binder resin unless otherwise specified.

PREPARATION EXAMPLE 1

| | |
|---|---|
| Binder resin (Polyester resin EX-103, Sanyo Chemical Industries, Ltd.) | 100 parts |
| Carbon black (MA-100, Mitsubishi Kasei Corp.) | 9 parts |
| Charge control agent (T-77, Hodogaya Chemical Co., Ltd.) | 2 parts |
| Low-molecular weight polypropylene (Biscol 550P, Sanyo Chemical Industries, Ltd.) | 1.5 parts |

The above raw material components were premixed and then continuously kneaded in a kneader heated at 150° C. The composite thus obtained was cooled to room temperature and roughly milled to about 1 mm×1 mm by using a cutter mill, followed by pulverization in a jet mill and classification in air flow classification equipment to obtain a first toner having a weight-average particle size of 10 μm.

PREPARATION EXAMPLE 2

A second toner is prepared in the same manner as in the Preparation Example 1 except that TBH1500 (styrene-acrylate copolymer resin, Sanyo Chemical Industries, Ltd.) was used as a binder resin, TRH (Hodogaya Chemical Co., Ltd.) was used as a charge control agent, and the weight-average particle size was 9 μm.

EMBODIMENT 1

The first toner obtained in Preparation Example 1 was mixed with 0.4% by weight of a hydrophobic silica (R972, product of Nippon Aerosil) based on the first toner by using a high-speed flow type mixer, and then mixed with 1.3% by weight of polytetrafluoroethylene fine powder, wherein weight-average particle size is 5.5 μm and the content of fine particles each having a size smaller than 3 μm is less than 22% by weight of the total weight, by using the same mixer to obtain a final developer.

The developer thus obtained was placed into a toner cartridge in which a titanyl phthalocyanine photoreceptor was charged by a scorotron charging method, which was then set into a commercially available PC-PR1000 printer (product of NEC) equipped with a hot roll fuser. Variation in the fog density and the image density were measured during initial development. Also, the same test was performed after a running operation using 5,000 papers. The photoreceptor potential was controlled by an external high voltage power source in the state in which the scorotron charging device was insulated from the printer.

The fog density on the photoreceptor holding the developer was measured as follows. A transfer medium to which the developer was transferred from the photoreceptor was bonded to a sheet of paper to obtain a sample. Optical reflective density was measured at arbitrary five points on the sample using a Macbeth densitometer. Also, the optical reflective density of a blank transfer medium attached to a support was measured as a blank density. The blank density was subtracted from the optical reflective densities measured at the five points, which were then averaged to obtain a density of fog.

Thus obtained fog density was plotted while changing the charged photoreceptor potential during the initial development and after the running operation so as to obtain high potential fog generating surface potential at which the fog density exceeded 0.02, and a low potential fog generating surface potential at which the fog density exceeded 0.02. Also, the absolute value of the difference between the high potential fog generating surface potential and the low potential fog generating surface potential was obtained as a potential range providing acceptable reduced fog.

The image density was measured as follows. During initial development and after a running operation using 5000 papers, a solid black image was developed by using a potential within the range in which the fog density was sufficiently reduced. Subsequently, the optical reflective density of the solid black image was measured at five arbitrary points. The optical reflective densities thus measured were averaged to obtain an image density.

The developer of Embodiment 1 was placed into a toner cartridge in which a titanyl phthalocyanine photoreceptor was charged by a brush charging method, which was then set into a commercially available PC-PR1000E/4 printer (product of NEC) equipped with a hot roll fuser. Variation in the fog density and the image density were measured during initial development in the same manner as described above. Also, the same test was performed after a running operation using 5,000 papers.

EMBODIMENT 2

A developer was prepared in the same manner as in Embodiment 1 except that mixing of the first toner and hydrophobic silica and mixing of polytetrafluoroethylene thereinto were simultaneously effected, and that the amount of the polytetrafluoroethylene fine powder was 2% by weight based on the toner. The developer was measured in the same manner as Embodiment 1.

EMBODIMENT 3

The second toner obtained in Preparation Example 2 was mixed with 1.5% by weight of a hydrophobic silica (R972, product of Nippon Aerosil) based on the toner by using a high-speed flow type mixer, and then mixed with 1.5% by weight of polytetrafluoroethylene-perfluoroalkyl ether copolymer fine powder, wherein weight-average particle size is 6 μm and the content of fine particles each having a size smaller than 3 μm is less than 18% by weight of the total weight, by using the same mixer, to obtain a final developer.

EMBODIMENT 4

A developer was prepared in the same manner as in Embodiment 1 except that hydrophobic silica was not added.

COMPARATIVE EXAMPLE 1

The first toner obtained in Preparation Example 1 was mixed with 0.4% by weight of a hydrophobic silica (R972, product of Nippon Aerosil) based on weight of the first toner by using a high-speed flow type mixer to obtain a final developer.

COMPARATIVE EXAMPLE 2

A developer was prepared in the same manner as in Embodiment 2 except that the weight-average particles size was 3.9 μm and the content of the fine particles each having a size smaller than 3 μm was less than 33% by weight, and that the amount of polytetrafluoroethylene was 1.3% by weigh to the toner.

COMPARATIVE EXAMPLE 3

A developer was prepared in the same manner as in Embodiment 2 that except the amount of polytetrafluoroethylene was 13% by weight of the toner.

COMPARATIVE EXAMPLE 4

A developer was prepared in the same manner as in Embodiment 2 except that polytetrafluoroethylene was replaced by polyvinylidene fluoride having a weight-average particle size of 5 μm and that amount of the additive was 1.3% by weight of the toner.

COMPARATIVE EXAMPLE 5

A developer was prepared in the same manner as in Embodiment 2 except the polytetrafluoroethylene fine powder was replaced by polyethylene having a weight-average particle size of 4 μm and the amount of the additive was 4% by weight of the total weight.

The developers prepared by Embodiments 2 to 4 and Comparative Examples 1–5 were charged into two kinds of toner cartridges, which were then set into a PC-PR1000 printer and a PC-PR1000E/4 printer, respectively. During initial development using these printers, variation in the fog density and the image density were measured while varying the charged photoreceptor potential. In the case where no fog was generated during the initial development, the same test was performed after a running operation using 5,000 sheets of paper.

The results of the measurements are shown in Table 1 for Embodiments 1–4 and Comparative Examples 1–5. In this table, as in other following tables, V1 (a negative voltage) is the higher critical potential at which high potential fog occurred, V2 (a negative voltage) is the lower critical potential at which low potential fog occurred, and V3 (a positive voltage) is a potential range in which fog was sufficiently reduced. In the Tables, "could not measured" means "fog occurred at any practical potential, thereby being unable to provide any significant critical potential".

TABLE 1

| Charging method | Timing of Evaluation | V1 (−V) | V2 (−V) | V3 (V) | D |
|---|---|---|---|---|---|
| Emb. 1 | | | | | |
| Scorotron | Initial Development | 800 | 250 | 550 | 1.42 |
| | After running | 850 | 250 | 600 | 1.44 |
| Brush | Initial Development | >1500 | 600 | >900 | 1.40 |
| | After running | >1500 | 600 | >900 | 1.43 |
| Emb. 2 | | | | | |
| Scorotron | Initial Development | 750 | 250 | 500 | 1.41 |
| | After running | 800 | 250 | 550 | 1.43 |
| Brush | Initial Development | 1400 | 600 | 800 | 1.42 |
| | After running | 1500 | 600 | 900 | 1.42 |
| Emb. 3 | | | | | |
| Scorotron | Initial Development | 700 | 300 | 400 | 1.36 |
| | After running | 750 | 250 | 500 | 1.33 |
| Brush | Initial Development | 1300 | 700 | 600 | 1.35 |
| | After running | 1300 | 700 | 600 | 1.36 |
| Emb. 4 | | | | | |
| Scorotron | Initial Development | 650 | 250 | 400 | 1.43 |
| | After running | 750 | 250 | 500 | 1.41 |
| Brush | Initial Development | 1400 | 800 | 600 | 1.41 |
| | After running | 1350 | 800 | 550 | 1.41 |
| Com. Ex. 1 | | | | | |
| Scorotron | Initial Development | 700 | 300 | 400 | 1.26 |
| | After running | 700 | 350 | 350 | 1.23 |
| Brush | Initial Development | could not measured | | | 1.21 |
| | After running | could not measured | | | 1.22 |
| Com. Ex. 2 | | | | | |
| Scorotron | Initial Development | could not measured | | | 1.38 |
| | After running | could not measured | | | 1.40 |
| Brush | Initial Development | could not measured | | | 1.37 |
| | After running | could not measured | | | 1.39 |
| Com. Ex. 3 | | | | | |
| Scorotron | Initial Development | 300 | 250 | 50 | 1.47 |
| | After running | 300 | 250 | 50 | 1.45 |
| Brush | Initial Development | 750 | 600 | 150 | 1.45 |
| | After running | 800 | 600 | 200 | 1.47 |
| Com. Ex. 4 | | | | | |
| Scorotron | Initial Development | could not measured | | | 0.78 |
| | After running | not measured | | | |
| Brush | Initial Development | could not measured | | | 0.65 |
| | After running | not measured | | | |
| Com. Ex. 5 | | | | | |
| Scorotron | Initial Development | could not measured | | | 1.05 |

TABLE 1-continued

| Charging method | Timing of Evaluation | V1 (–V) | V2 (–V) | V3 (V) | D |
|---|---|---|---|---|---|
| After running | | not measured | | | |
| Brush | Initial Development | could not measured | | | 1.12 |
| After running | | not measured | | | |

V1: high potential fog generating surface potential (–V)
V2: low potential fog generating surface potential (–V)
V3: magnitude of a range in which fog was sufficiently reduced (V)
D: optical reflective density of solid black image As shown in Table 1, when each of the developers prepared in accordance with Embodiments 1–4 was used, fog was sufficiently reduced, thereby providing a clear and sharp image having an excellent image resolution and a high image density. Thus, it was observed that such a clear and sharp image was obtained within a wide range of developing conditions, and that a clear image was obtained even when the performances of a developer and a development apparatus including a photoreceptor changed due to repeated developing operations or the passage of time.

PREPARATION EXAMPLE 3

| | |
|---|---|
| Binder resin (Polyester resin EX-103, Sanyo Chemical Industries, Ltd.) | 100 parts |
| Carbon black (MA-100, Mitsubishi Kasei Corp.) | 9 parts |
| Charge control agent (T-77, Hodogaya Chemical Co., Ltd.) | 2 parts |
| Low-molecular weight polypropylene (Biscol 550P, Sanyo Chemical Industries, Ltd.) | 1.5 parts |

The above raw material components were premixed and then continuously kneaded in a kneader heated at 150° C. The composite thus obtained was cooled to room temperature and roughly milled to about 1 mm×1 mm by using a cutter mill, followed by pulverization in a jet mill to obtain finely pulverized particles having a weight-average particle size of 8.4 μm.

PREPARATION EXAMPLE 4

Fine particles were prepared in the same manner as in Preparation Example 3 except that TBH1500 (styrene-acrylate copolymer resin, Sanyo Chemical Industries, Ltd.) was used as a binder resin, that TRH (Hodogaya Chemical Co., Ltd.) was used as a charge control agent, and that the weight-average particle size was 8.3 μm.

EMBODIMENT 5

The finely pulverized particles obtained in Preparation Example 3 were mixed with 0.4% by weight of a hydrophobic silica (R972, product of Nippon Aerosil) based on the amount of the finely pulverized particles by using a high-speed flow type mixer, then mixed with 1.3% by weight of a polytetrafluoroethylene fine powder having a weight-average particle size of 4 μm using a Turbula-Shaker-Mixer to obtain a mixture of the finely pulverized particles and the fluoropolymer micropowder. Subsequently, only the finely pulverized particles were classified with a Dispersion Separator to determine classification conditions for obtaining classified particles having a weight-average particle size of 10 μm. The above-described mixture was then classified under the classification conditions thus determined, thereby removing fine powder particles from the mixture to obtain a developer having a weight-average particle size of 10 μm.

The developer thus obtained was placed into a toner cartridge in which a titanyl phthalocyanine photoreceptor was charged by a scorotron charging method, which was then set into a commercially available PC-PR1000 printer (product of NEC) equipped with a hot roll fuser. Variation in the fog density and the image density were measured during initial development. Also, the same test was performed after a running operation using 5,000 papers. The photoreceptor potential was controlled by an external high voltage power source in the state in which the scorotron charging device was insulated from the printer.

The fog density on the photoreceptor holding the developer was measured as follows. A transfer medium to which the developer was transferred from the photoreceptor was bonded to a sheet off paper to obtain a sample. Optical reflective density was measured at five arbitrary points on the sample using a Macbeth densitometer. Also, the optical reflective density of a blank transfer medium attached to a support was measured as a blank density. The blank density was subtracted from the optical reflective densities measured at the five points, which were then averaged to obtain a density of fog.

Thus obtained fog density was plotted while changing the charged photoreceptor potential during the initial development and after the running operation so as to obtain a high potential fog generating surface potential at which the fog density exceeded 0.02, and a low potential fog generating surface potential at which the fog density exceeded 0.02. Also, the absolute value of the difference between the high potential fog generating surface potential and the low potential fog generating surface potential was obtained as a potential range providing acceptable reduced fog.

The image density was measured as follows. During initial development and after a running operation using 5000 papers, a solid black image was developed by using a potential within the range in which the fog density was sufficiently reduced. Subsequently, the optical reflective density of the solid black image was measured at five arbitrary points. The optical reflective densities thus measured were averaged to obtain an image density.

The developer of Embodiment 5 was placed into a toner cartridge in which a titanyl phthalocyanine photoreceptor was charged by a brush charging method, which was then set into a commercially available PC-PR1000E/4 printer (product of NEC) equipped with a hot roll fuser. Variation in the fog density and the image density were measured during initial development in the same manner as describe above. Also, the same test was performed after a running operation using 5,000 papers.

EMBODIMENT 6

A developer was prepared in the same manner as in Embodiment 5 except that a polytetrafluoroethylene fine powder and finely pulverized particles were simultaneously supplied to a Dispersion Separator through a common supply inlet such that the amount of the polytetrafluoroethylene fine powder became 1.3% by weight based on the amount of the finely pulverized particles, thereby performing mixing and classification at the same time.

EMBODIMENT 7

A developer was prepared in the same manner as in Embodiment 5 except that a polytetrafluoroethylene fine powder was mixed with finely pulverized particles by using a Turbula-Shaker-Mixer equipped with an air gun in which the fluoropolymer powder was atomized from the air gun into the finely pulverized particles while shaking the finely pulverized particles such that the amount of the polytetrafluoroethylene fine powder became 1.3% by weight based on the amount of the finely pulverized particles.

EMBODIMENT 8

A developer was prepared in the same manner as in Embodiment 5 except that the finely pulverized particles prepared in Preparation Example 2 were used.

EMBODIMENT 9

A developer was prepared in the same manner as in Embodiment 5 except that no hydrophobic silica was used.

EMBODIMENT 10

A developer was prepared in the same manner as in Embodiment 5 except that a polytetrafluoroethylene fine powder having a weight-average particle size of 5.5 μm was incorporated into finely pulverized particles in an amount of 2% by weight based on the amount of the finely pulverized particles.

EMBODIMENT 11

A developer was prepared in the same manner as in Embodiment 5 except that a polytetrafluoroethylene-perfluoroalkylether copolymer fine powder having a weight-average particle size of 7.4 μm was incorporated into finely pulverized particles in an amount of 4% by weight based on the amount of the finely pulverized particles.

The developers prepared by Embodiments 5–10 and Comparative Examples 6–13 which will be detailed later were charged into two kinds of toner cartridges, which were then set into a PC-PR1000 printer and a PC-PR1000E/4 printer, respectively. During initial development using these printers, variation in the fog density and the image density were measured while varying the charged photoreceptor potential. In the case where no fog was generated during the initial development, the same test was performed after a running operation using 5,000 papers.

The results of the measurements are shown in Table 2 for Embodiments 5–11.

TABLE 2

| Charging method | Timing of Evaluation | V1 (–V) | V2 (–V) | V3 (V) | D |
|---|---|---|---|---|---|
| Emb. 5 | | | | | |
| Scorotron | Initial Development | 800 | 300 | 500 | 1.42 |
| | After running | 850 | 300 | 550 | 1.44 |
| Brush | Initial Development | >1500 | 650 | >850 | 1.44 |
| | After running | >1500 | 650 | >850 | 1.43 |
| Emb. 6 | | | | | |
| Scorotron | Initial Development | 750 | 250 | 500 | 1.41 |
| | After running | 800 | 300 | 500 | 1.43 |
| Brush | Initial Development | >1500 | 600 | >900 | 1.44 |
| | After running | >1500 | 600 | >900 | 1.42 |
| Emb. 7 | | | | | |
| Scorotron | Initial Development | 800 | 300 | 500 | 1.42 |
| | After running | 850 | 350 | 500 | 1.43 |
| Brush | Initial Development | >1500 | 600 | >900 | 1.45 |
| | After running | >1500 | 650 | >850 | 1.45 |

TABLE 2-continued

| Charging method | Timing of Evaluation | V1 (–V) | V2 (–V) | V3 (V) | D |
|---|---|---|---|---|---|
| Emb. 8 | | | | | |
| Scorotron | Initial Development | 700 | 250 | 450 | 1.43 |
| | After running | 800 | 300 | 500 | 1.41 |
| Brush | Initial Development | >1500 | 550 | >950 | 1.44 |
| | After running | >1500 | 550 | >950 | 1.45 |
| Emb. 9 | | | | | |
| Scorotron | Initial Development | 650 | 250 | 400 | 1.43 |
| | After running | 750 | 250 | 500 | 1.41 |
| Brush | Initial Development | 1400 | 800 | 600 | 1.41 |
| | After running | 1350 | 800 | 550 | 1.41 |
| Emb. 10 | | | | | |
| Scorotron | Initial Development | 900 | 250 | 650 | 1.42 |
| | After running | 900 | 200 | 700 | 1.44 |
| Brush | Initial Development | >1500 | 550 | >950 | 1.40 |
| | After running | >1500 | 500 | >1000 | 1.43 |
| Emb. 11 | | | | | |
| Scorotron | Initial Development | 700 | 300 | 400 | 1.36 |
| | After running | 800 | 300 | 500 | 1.39 |
| Brush | Initial Development | >1500 | 700 | >800 | 1.38 |
| | After running | >1500 | 700 | >800 | 1.35 |

V1: high potential fog generating surface potential (–V)
V2: low potential fog generating surface potential (–V)
V3: magnitude of a range in which fog was sufficiently reduced (V)
D: optical reflective density of solid black image As shown in Table 2, when each of developers prepared in accordance with Embodiments 5–11 was used, fog was sufficiently reduced, thereby providing a clear and sharp image having an excellent image resolution and a high image density. Thus, it was observed that such a clear and sharp image was obtained within a wide range of developing conditions, and that a clear image was obtained even when the performance of a development apparatus including a developer and a photoreceptor changed with the passage of time due to repeated developing operations.

COMPARATIVE EXAMPLE 6

A developer was prepared in the same manner as in Embodiment 5 except that no polytetrafluoroethylene was used.

Test results for Comparative Examples are shown in Table 3, similarly to Table 2. As shown in Table 3, when scorotron charging was used, only an image having a low density was obtained although fog was sufficiently reduced in a certain potential range. When brush charging was used, no potential existed at which fog was sufficiently reduced, and only an image having a low density was obtained.

COMPARATIVE EXAMPLE 7

The finely pulverized particles obtained in Preparation Example 5 were classified to obtain particles with weight-average particle size of 10 μm. The classified particles were mixed with 0.4% by weight of a hydrophobic silica based on the amount of the classified particles using a high-speed flow type mixer, and then with 1.3% by weight of a polytetrafluoroethylene fine powder with weight-average particle size of 4 μm using a Turbula-Shaker-Mixer to obtain a developer.

As shown in Table 3, in both cases of scorotron charging and bush charging, fog was sufficiently reduced only in a narrow potential range although images having a high image density were obtained.

COMPARATIVE EXAMPLE 8

A developer was prepared in the same manner as in Embodiment 6 except that a hydrophobic silica and a polytetrafluoroethylene fine powder were simultaneously blended with finely pulverized particles using a high-speed flow type mixer.

As shown in Table 3, in both cases of scorotron charging and bush charging, a high image density was obtained. However, when scorotron charging was used, fog was sufficiently reduced only in a narrow potential range. With brush charge, no potential existed at which fog was sufficiently reduced.

COMPARATIVE EXAMPLE 9

The finely pulverized particles obtained in Preparation Example 5 were mixed with 1.3% by weight of a polytetrafluoroethylene fine powder with weight-average particle size of 4 μm using a Turbula-Shaker-Mixer to obtain a mixture of the finely pulverized particles and the fluoropolymer fine powder. The mixture was then classified using a Dispersion Separator to remove fine powder particles from the mixture, thereby obtaining particles with weight-average particle size of 10 μm. Using a high-speed flow type mixer, the classified particles were mixed with 0.4% by weight of a hydrophobic silica (R972, product of Nippon Aerosil) based on the amount of the classified particles to obtain a developer.

As shown in Table 3, in both cases of scorotron charging and brush charging, fog was sufficiently reduced only in a narrow potential range although images having a high density were obtained.

COMPARATIVE EXAMPLE 10

A developer was prepared in the same manner as in Embodiment 5 except that a polytetrafluoroethylene fine powder with weight-average particle size of 1.9 μm was incorporated in the finely pulverized particles in an amount of 0.4% by weight based on the amount of the finely pulverized particles.

As shown in Table 3, in both cases of scorotron charging and brush charging, a high image density was obtained. However, with brush charge, no potential existed at which fog was sufficiently reduced although fog was sufficiently reduced in a certain potential range with scorotron.

COMPARATIVE EXAMPLE 11

A developer was prepared in the same manner as in Embodiment 7 except that the polytetrafluoroethylene fine powder was incorporated into the finely pulverized particles in an amount of 13% by weight based on the amount of the finely pulverized particles.

As shown in Table 3, in both cases of scorotron charging and bush charging, fog was sufficiently reduced only in a narrow potential range although a high image density was obtained. In addition, deficiency of fixing occurred in the imaged after fixing.

COMPARATIVE EXAMPLE 12

A developer was prepared in the same manner as in Embodiment 5 except that in place of the polytetrafluoroethylene fine powder, polyvinylidene fluoride powder with weight-average particle size of 5 μm was incorporated into a toner in an amount of 1.3% by weight based on the amount of the toner.

As shown in Table 3, in both cases of scorotron charging and bush charging, no potential existed at which fog was sufficiently reduced and only images having a very low image density were obtained.

COMPARATIVE EXAMPLE 13

A developer was prepared in the same manner as in Embodiment 5 except that in place of the polytetrafluoroethylene fine powder, polyethylene powder with weight-average particle size of 4 μm was incorporated into a toner in an amount of 4% by weight based on the amount of the toner.

As shown in Table 3, in both cases of scorotron charging and brush charging, no potential existed at which fog was sufficiently reduced and only images having a very low image density were obtained.

TABLE 3

| Charging method | Timing of Evaluation | V1 (−V) | V2 (−V) | V3 (V) | D |
|---|---|---|---|---|---|
| Com. Ex. 6 | | | | | |
| scortron | Initial Development | 700 | 300 | 400 | 1.26 |
| | After running | 700 | 350 | 350 | 1.23 |
| Brush | Initial Development | could not measured | | | 1.21 |
| Com. Ex. 7 | | | | | |
| Scorotron | Initial Development | 600 | 500 | 100 | 1.46 |
| | After running | 600 | 550 | 50 | 1.45 |
| Brush | Initial Development | 900 | 700 | 200 | 1.45 |
| | After running | 1000 | 650 | 350 | 1.45 |
| Com. Ex. 8 | | | | | |
| Scorotron | Initial Development | 300 | 250 | 50 | 1.47 |
| | After running | 300 | 250 | 50 | 1.46 |
| Brush | Initial Development | could not measured | | | 1.48 |
| Com. Ex. 9 | | | | | |
| Scorotron | Initial Development | 550 | 250 | 250 | 1.40 |
| | After running | 550 | 300 | 200 | 1.39 |
| Brush | Initial Development | 1000 | 600 | 400 | 1.44 |
| | After running | 1000 | 700 | 300 | 1.42 |
| Com. Ex. 10 | | | | | |
| Scorotron | Initial Development | 800 | 250 | 550 | 1.45 |
| | After running | 750 | 300 | 400 | 1.48 |
| Brush | Initial Development | could not measured | | | 1.50 |
| Com. Ex. 11 | | | | | |
| Scorotron | Initial Development | could not measured | | | 1.50 |
| Brush | Initial Development | could not measured | | | 1.49 |
| Com. Ex. 12 | | | | | |
| Scorotron | Initial Development | could not measured | | | 0.75 |
| Brush | Initial Development | could not measured | | | 0.65 |
| Com. Ex. 13 | | | | | |
| Scorotron | Initial Development | could not measured | | | 0.88 |
| Brush | Initial Development | could not measured | | | 0.98 |

V1: high potential fog generating surface potential (−V)
V2: low potential fog generating surface potential (−V)
V3: magnitude of a range in which fog was sufficiently reduced (V)
D: optical reflective density of solid black image As shown in the Embodiments 5–11 and Comparable Examples 5–13, the advantages of the present invention can be obtained when fine powder particles having a size equal to or smaller than 3 μm are removed from a finely pulverized fluoropolymer micropowder.

In the specification, methods for preparing electrostatic image developers have been described in which the above finely pulverized powder was incorporated into a kneaded composite mainly containing a thermoplastic binder resin and a coloring pigment. However, the same effects can be obtained when the finely pulverized resin powder is mixed into a kneaded composite before pulverization, and classification is performed after the pulverization.

Since above embodiments are described only for examples, the present invention is not limited to such embodiments and it will be obvious for those skilled in the art that various modifications or alterations can be easily made based on the above embodiments within the scope of the present invention.

What is claimed is:

1. A method for manufacturing a nonmagnetic single-component developer including a step of admixing fluoropolymer fine powder to a toner containing a thermoplastic binder resin and a coloring pigment as main components thereof in an amount of 0.1 to 10% by weight of said toner, said fluoropolymer fine powder having a weight-average particle size smaller than the weight-average particle size of said toner, the proportion of particles present in said fluoropolymer fine powder and having a particle size not larger than 3 μm being less than 30% by weight of said fluoropolymer fine powder.

2. A method for manufacturing a nonmagnetic single-component developer as defined in claim 1 wherein said thermoplastic binder resin is a polyester binder resin.

3. A method for manufacturing a nonmagnetic single-component developer as defined in claim 1 wherein said fluoropolymer fine powder is made of polytetrafluoroethylene.

4. A method for manufacturing a nonmagnetic single-component developer as defined in claim 1 wherein said fluoropolymer fine powder has a weight-average particle size of 4 to 20 μm.

5. A method for manufacturing a nonmagnetic single-component developer as defined in claim 1 further including a step of admixing an inorganic powder to said toner in an amount of 0.1 to 5% before said adding of the fluoropolymer fine powder.

6. A method for manufacturing a nonmagnetic single-component developer as defined in claim 5 wherein said inorganic powder is a colloidal silica subjected to surface modifying by a hydrophobisation agent.

7. A method for manufacturing a nonmagnetic single-component developer including steps of: pulverizing a kneaded composite containing a thermoplastic binder resin and a coloring pigment as main components thereof to obtain a pulverized composite; classifying said pulverized composite by particle size to obtain a classified toner; admixing said classified toner with a fluoropolymer fine powder having a weight-average particle size smaller than the weight-average particle size of said classified toner to obtain a mixture powder, a proportion of said fluoropolymer fine powder being 0.1 to 10% by weight of said mixture powder; and classifying said mixture powder by particle size.

8. A method for manufacturing a nonmagnetic single-component developer as defined in claim 7 wherein said admixing does not provide a shear force to said pulverized composite and said fluoropolymer fine powder.

9. A method for manufacturing a nonmagnetic single-component developer as defined in claim 8 wherein said admixing is effected in a container by shaking.

10. A method for manufacturing a nonmagnetic single-component developer as defined in claim 8 wherein said admixing is effected by simultaneously supplying said pulverized composite and said fluoropolymer fine powder into a classifying equipment.

11. A method for manufacturing a nonmagnetic single-component developer as defined in claim 8 wherein said admixing is effected by atomizing said fluoropolymer fine powder into said pulverized composite.

12. A method for manufacturing a nonmagnetic single-component developer as defined in claim 7 wherein said thermoplastic binder resin is a polyester resin.

13. A method for manufacturing a nonmagnetic single-component developer as defined in claim 7 wherein said fluoropolymer fine powder is made of polytetrafluoroethylene.

14. A method for manufacturing a nonmagnetic single-component developer as defined in claim 7 wherein said fluoropolymer fine powder has a weight-average particle size of 4 to 20 μm.

15. A method for manufacturing a nonmagnetic single-component developer as defined in claim 7 further including a step of admixing an inorganic powder to said toner in an amount of 0.1 to 5% before said adding of said fluoropolymer fine powder.

16. A method for manufacturing a nonmagnetic single-component developer as defined in claim 15 wherein said inorganic powder is a colloidal silica subjected to surface modifying by a hydrophobisation agent.

17. A method for manufacturing a nonmagnetic single-component developer as defined in claim 1, wherein said fluoropolymer fine powder is admixed to said toner in an amount of greater than 1.0% to 10% by weight of said toner.

18. A method for manufacturing a nonmagnetic single-component developer as defined in claim 7, wherein said proportion of said fluoropolymer fine powder is greater than 1.0% to 10% by weight of said mixture powder.

* * * * *